US011866231B2

(12) United States Patent
Khattar

(10) Patent No.: US 11,866,231 B2
(45) Date of Patent: Jan. 9, 2024

(54) HINGED CLOSURE

(71) Applicant: Novembal USA Inc., Edison, NJ (US)

(72) Inventor: Sanjeev Khattar, Brampton (CA)

(73) Assignee: NOVEMBAL USA INC.

( * ) Notice: Subject to any disclaimer, the term of this patent is extended or adjusted under 35 U.S.C. 154(b) by 0 days.

(21) Appl. No.: 17/036,764

(22) Filed: Sep. 29, 2020

(65) Prior Publication Data

US 2022/0097923 A1 Mar. 31, 2022

(51) Int. Cl.
*B65D 41/34* (2006.01)
*B65D 55/16* (2006.01)

(52) U.S. Cl.
CPC ..... *B65D 41/3409* (2013.01); *B65D 55/16* (2013.01)

(58) Field of Classification Search
CPC ..... B65D 47/0814; B65D 55/16; B65D 41/3428; B65D 2401/15; B65D 2401/30; B65D 47/0809; B65D 41/3409
See application file for complete search history.

(56) References Cited

U.S. PATENT DOCUMENTS

| | | | | |
|---|---|---|---|---|
| 10,654,624 | B2 * | 5/2020 | Sung | B65D 55/16 |
| 10,836,544 | B2 * | 11/2020 | Kim | B65D 41/48 |
| 10,843,849 | B1 * | 11/2020 | Berge | B65D 47/0857 |
| 10,926,923 | B2 * | 2/2021 | Berroa Garcia | B65D 41/32 |
| 2011/0000137 | A1 * | 1/2011 | Druitt | B65D 47/0809 49/399 |
| 2021/0039841 | A1 * | 2/2021 | Pucci | B65D 41/325 |
| 2022/0055804 | A1 * | 2/2022 | Khattar | B65D 47/0838 |

FOREIGN PATENT DOCUMENTS

| | | | |
|---|---|---|---|
| JP | 08301329 | A | 11/1996 |
| JP | 11278520 | A | 10/1999 |
| JP | 2005306421 | A | 11/2005 |

* cited by examiner

*Primary Examiner* — Shawn M Braden

(57) ABSTRACT

Hinged closures for containers are provided. The hinged closures allow for a closure that can be held in the open position with a large opening angle. The hinged closures include a lid portion and a tamper evident band interconnected by a hinge portion. The hinge portion can be formed from two connecting bands and a central flexible band, or a continuous band having variable thickness and a central thinner flexible area.

10 Claims, 11 Drawing Sheets

100

100

200

200

300

300

300

300

300

300

HINGED CLOSURE

FIELD OF INVENTION

The present invention relates to bottle closures for containers. More particularly, the invention relates to hinged bottle closures.

BACKGROUND

Hinged closures that can remain open are needed for various uses such as in conjunction with containers used to house carbonated and non-carbonated beverages, water or other liquids, powders, oils, condiments, and beauty products, among others. Existing closures sacrifice desirable characteristics, such as opening angle range, flexibility, inability to tether to a corresponding container, and the presence of a locking mechanism.

SUMMARY

The present disclosure relates to hinged closures for a container, such as for a beverage. The hinged closures allow for closures that can be held in the open position with a large opening angle. The closure can include an upper lid portion, a tamper evident band, and a hinge portion. The hinge portion integrally interconnects the lid portion and the tamper evident band, including at least one connecting band and a flexible portion.

In one aspect, the hinge portion includes a pair of connecting bands and a central flexible portion. In another aspect, the hinge portion includes a pair of flexible portions and a central connecting band.

In yet another aspect, the hinge portion comprises a continuous band having variable thickness and a central flexible area. The central flexible area is the thinnest point and is blended with the continuous band.

BRIEF DESCRIPTION OF THE DRAWINGS

Further aspects of the present disclosure will be more readily appreciated upon review of the detailed description of its various embodiments, described below, when taken in conjunction with the accompanying drawings.

FIG. 1A shows a perspective view; FIG. 1B provides an interior view including the hinge portion; FIG. 1C is a cross-sectional perspective view through central flexible portion; FIG. 1D is a cross-sectional perspective view through a connecting band; FIG. 1E is a side view of the closure from the hinged portion.

FIG. 1G shows the folded tamper band section; in FIG. 1H, the folded portion of the tamper band has been removed to show the horizontal slit.

FIG. 2A shows a perspective view; FIG. 2B provides a side view including the hinge portion; FIG. 2C is cross-sectional perspective view through a connecting band; FIG. 2D is a cross-sectional perspective view through the central flexible portion; FIG. 2E provides an interior view including the hinge portion. FIG. 2F is a perspective view of an embodiment of the tamper evident band of the closure.

FIG. 3A shows a perspective view; FIG. 3B provides a side view including the hinge portion; FIG. 3C is cross-sectional perspective view through a thicker portion; FIG. 3D is a cross-sectional perspective view through the thinner central flexible area; FIG. 3E provides an interior view including the hinge portion. FIG. 3F is a perspective view of an embodiment of the tamper evident band of the closure.

Figure 1A:
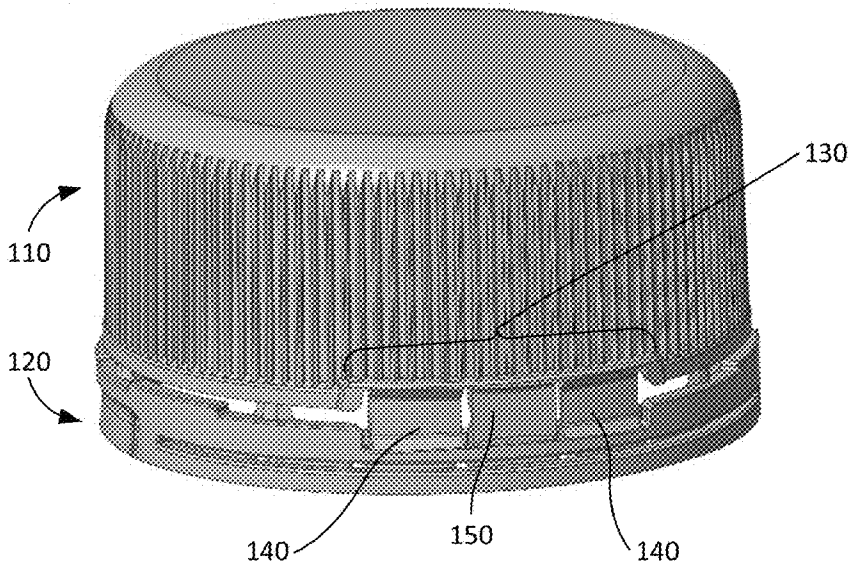
FIGS. 1A-1E provide an example of a hinged closure from various views in accordance with embodiments of the present disclosure, wherein the hinge portion includes two connecting bands and a central flexible portion having a groove.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

In accordance with the purpose(s) of the present disclosure, as embodied and broadly described herein, embodiments of the present disclosure, in some aspects, relate to hinged closures for containers having an opening. In general, embodiments of the present disclosure provide for hinged closures and methods of making hinged closures. For instance, the hinged closure described herein are generally used in connection with containers for dispensing products such as food and beverages (e.g. carbonated and non-carbonated beverages, water, oils or condiments, powders or granular products such as seasonings), beauty products (e.g. shampoos, lotions), and household products (e.g. adhesives, detergents). But the hinged closure of the present disclosure can also be used in connection with various other containers as desired. The hinged closure can be adapted for container applications having a screw closure and/or a snap closure, and for use with all applications, the hinged closure can remain in the open position and can have an opening angle of up to 240 degrees (e.g. up to 180 degrees for screw closure applications and up to 240 degrees for snap closure applications). Additionally, the hinged closures described herein advantageously provide for flexibility, tamper evidence, and evidence of tampering.

The present disclosure includes several embodiments of hinged closures with a hinge portion including at least one flexible portion, as shown in the figures. For instance, FIGS. 1A-1H illustrate one example of a hinged closure 100. In general, the hinged closures comprise an upper lid portion (or closure shell) 110 and a lower skirt portion forming a tamper evident band 120, which are integrally interconnected by the hinge portion 130. The skirt portion is generally ring shaped. The tamper evident band 120 can be retained on the bottle neck such as by a folded portion (see FIGS. 1C and 1D) or by including molded beads on the interior of the tamper evident band 120. The hinge portion 130 includes at least one connecting band 140 and at least one central flexible portion 150. In some embodiments, the hinge portion can comprise two connecting bands 140 and a central flexible portion 150 placed between the two connecting bands 140. In some embodiments, the hinge portion can comprise two flexible portions 150 and a central connecting band 140 placed between the two flexible portions 150. In some embodiments, the connecting bands 140 are vertical and thus are parallel to one another. In other embodiments, at least a portion of the connecting bands 140 are curved with respect to one another (e.g., crescent shaped) or can be angled. The connecting bands 140 and/or central flexible portion 150 can include lines of articulation to direct the bending force. In another embodiment the hinge portion can be a continuous band having variable thickness and a central thinner flexible area.

The central flexible portion 150 and the connecting bands 140 can have substantially the same thickness or the thickness can vary as desired. The central flexible portion 150 can have at least one groove 155 that forms a joint and/or flex point at which the central flexible portion 150 rotates relative to the tamper evident band 120 such that the lid portion can open up to 240 degrees from the closed position. Advantageously, the groove 155 functions as a reverse flex hinge that can flex and/or pop inwards upon flipping open the upper lid portion 110. The central flexible portion 150 thereby deforms, forming a memory position such that the upper lid portion 110 can remain in a semi-locked open condition. The closure lid can be flipped back to a closed position with a simple finger push. The groove 155 enables the upper lid portion 110 to be pivotable relative to the tamper evident band. The groove 155 can be on the core side (e.g. the interior side of the upper lid portion) or on the cavity side (e.g. the exterior side of the upper lid portion), depending upon the requirements of the closure.

In general, the groove 155 can be horizontal (e.g., zero degrees) to the long axis of the band. In some embodiments, a single groove 155 can be located in the center of the central flexible portion 150. In some embodiments, the groove 155 can be located at the upper portion of the central flexible portion 150. In other embodiments, a groove 155 can be located at both the upper and lower portions of the connecting band. In yet another embodiment, two smaller parallel grooves 155 can be closely placed to one another. In various embodiments, the groove 155 may be chamfered, angled, or slightly tapered at the center to provide a pinch area.

In some embodiments, the tamper evident band 120 can include a horizontal slit 180 below the tongue to allow more bending upon closure opening. Additional reinforcement of material (e.g., slit reinforcement) on the horizontal slit 180 can also be included as desired.

In various embodiments, the hinged closure can be formed using injection molding and can have various features suitable to efficient injection molding manufacture. In some embodiments, the hinged closure can include vertical openings alongside the hinge portion. Advantageously, the openings act as a split between the slide and the cavity of the injection mold, allowing the slide of the injection mold to follow the opening. In other embodiments, the openings alongside the hinge portion can be angled. The angled opening allows for improved flexibility of the hinge and can be tapered to prevent undercutting during the molding process. The removal of undercutting reduces the potential for damage when ejecting the closure from the mold, thereby reducing wastage and costs. In some embodiments, the closure can be molded as a single piece. No subsequent slitting operations are required to form the openings and/or voids (e.g. the openings alongside the hinge portion, between the connecting bands and central flexible portion, and the bottom slit). In other embodiments, the closure can include vertical knurls (or ribs). The knurls can provide additional strength to the closure and provide a grip surface for an end user (e.g., consumer) and/or a grip surface for the capping chuck during application of the closure onto the bottle finish at the packaging stage. When manufactured using injection molding, the split line between the slide and cavity can be such that knurls that are located on the hinge area will partially be molded by the slide to prevent undercutting.

As previously mentioned, the closures described herein can be screw closures or snap closures. When configured as a snap closure, horizontal slit 180 can be omitted. When configured as a screw closure, screw threads can be located on an interior surface of the upper lid portion 110. In either configuration, the closures can be from about 16 mm to about 110 mm, preferably 25 mm to 48 mm in diameter (e.g., for the beverage industry) or can alternatively be sized larger as desired to accommodate containers of various sizes. In example commercial embodiments, such as in a beverage container closure, the hinge can withstand a break force of about 25 N. However, in other embodiments, the hinge can be designed to withstand higher or lower break forces depending on various factors, such as the size of the container, the desired level of break force for a particular application, the required level of reusability, etc. The closure can also include locking means on the interior portion, such as ratchet (or lug) segments, laterally spaced apart a distance suitable to be engaged with the neck of the container. In some embodiments, the tamper evident band can include one or more beads molded into and positioned on the interior surface of the tamper evident band configured to engage the tamper evident ring of the container neck. Moreover, although the closures described and shown herein are substantially circular, in other embodiments the hinged closure could be ovoid, polygonal, or other shape to accommodate a variety of containers.

The skirt portion can be a tamper evident band or include other tamper-prevention means such as frangible bridges, which would be understood by one of ordinary skill in the art. Said bridges can be added (e.g., molded) into the primary cut (i.e., between the lid portion 110 and tamper evident band) and/or a secondary cut (i.e., positioned within the tamper evident band).

The hinged closures and methods of making described herein pertain primarily to plastic closures formed by injection molding. Such materials generally include thermoplastic polymers. However, other materials including elastomers, flexible metals, or other materials suitable for injection molding can be envisioned by one of ordinary skill in the art. Similarly, the hinged closures described herein could be manufactured using other methods including but not limited to compression molding and/or additive manufacturing.

Figure 1B:
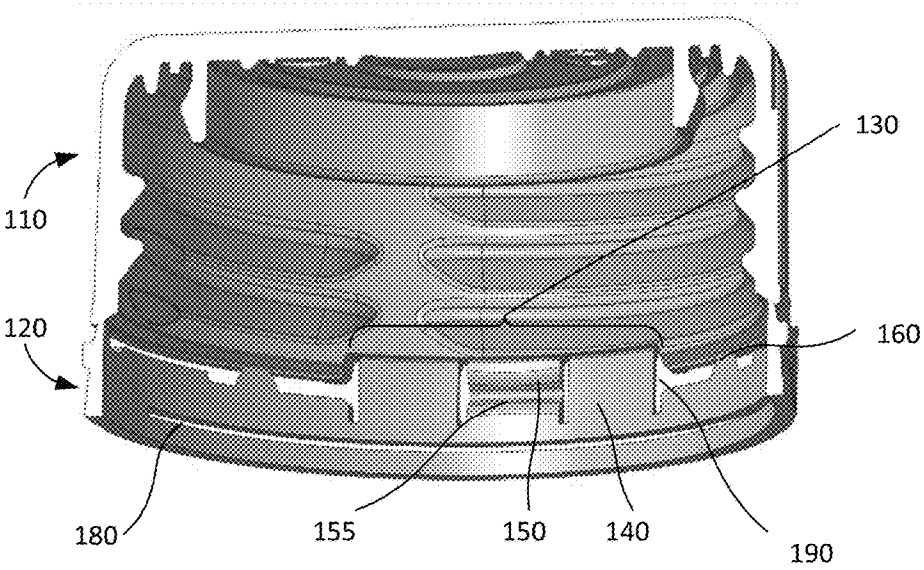
Figure 1C:
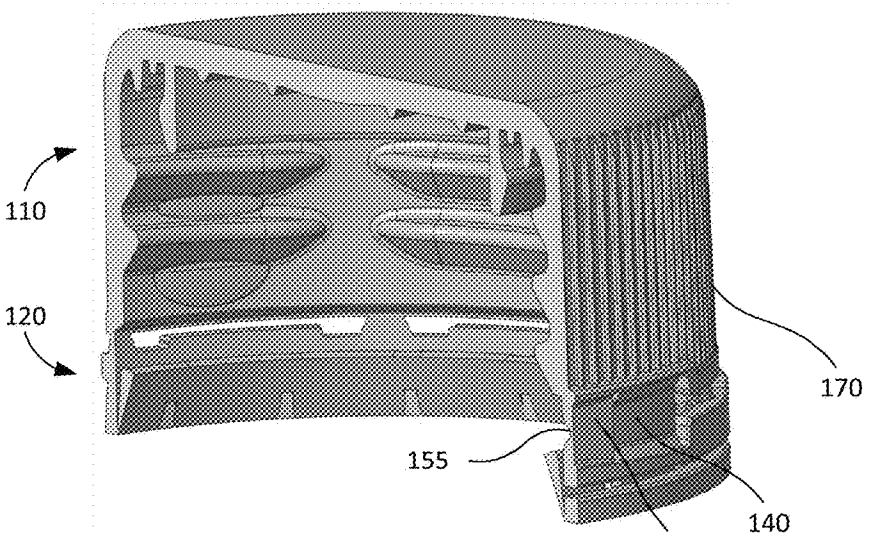
Figure 1D:
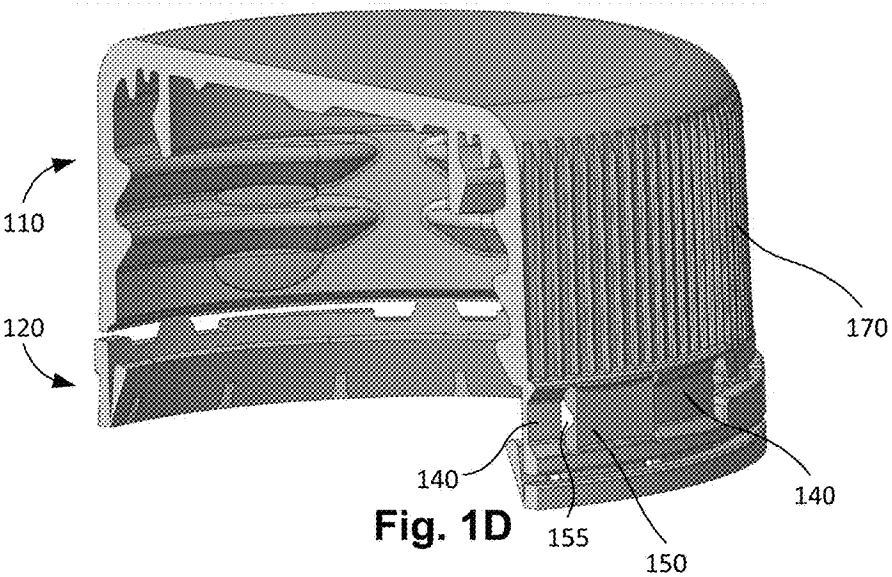
Figure 1E:
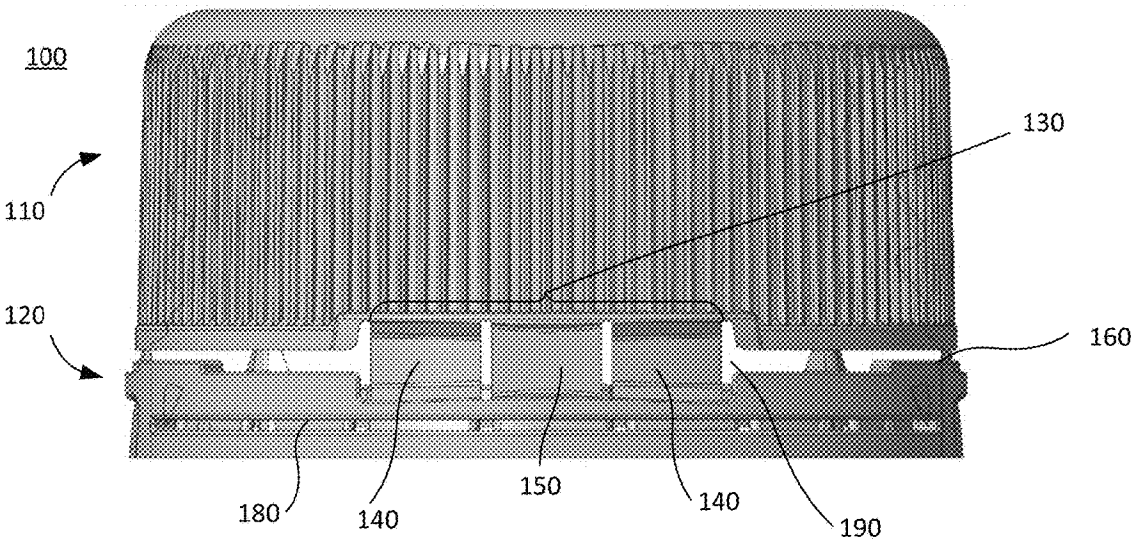
Figure 1F:
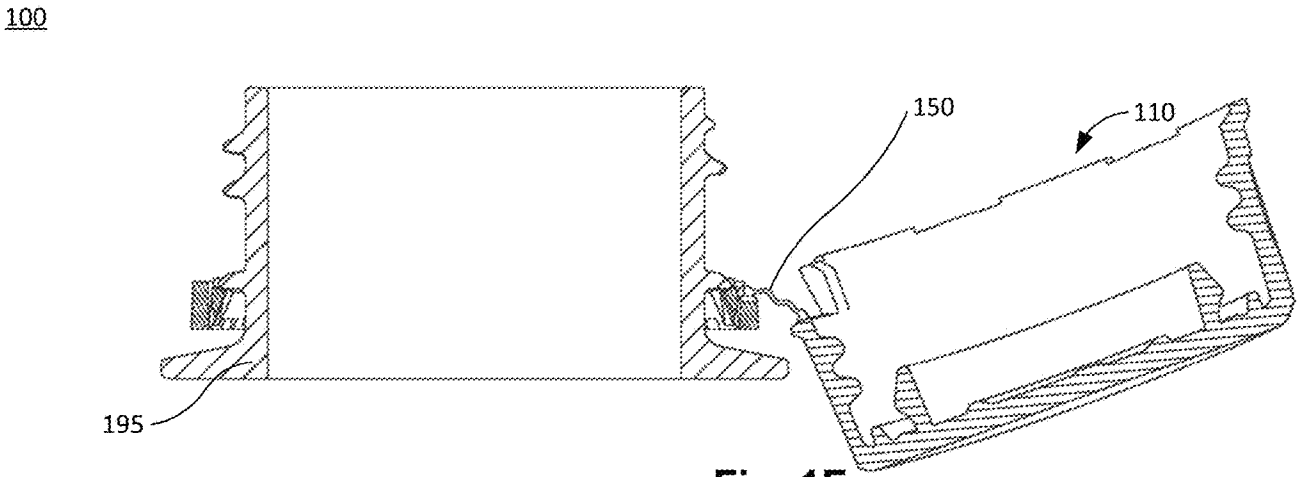
FIG. 1F is a cross-sectional view of an embodiment of the present disclosure in which the hinged closure in the open position and attached to a container.
Figure 1G:
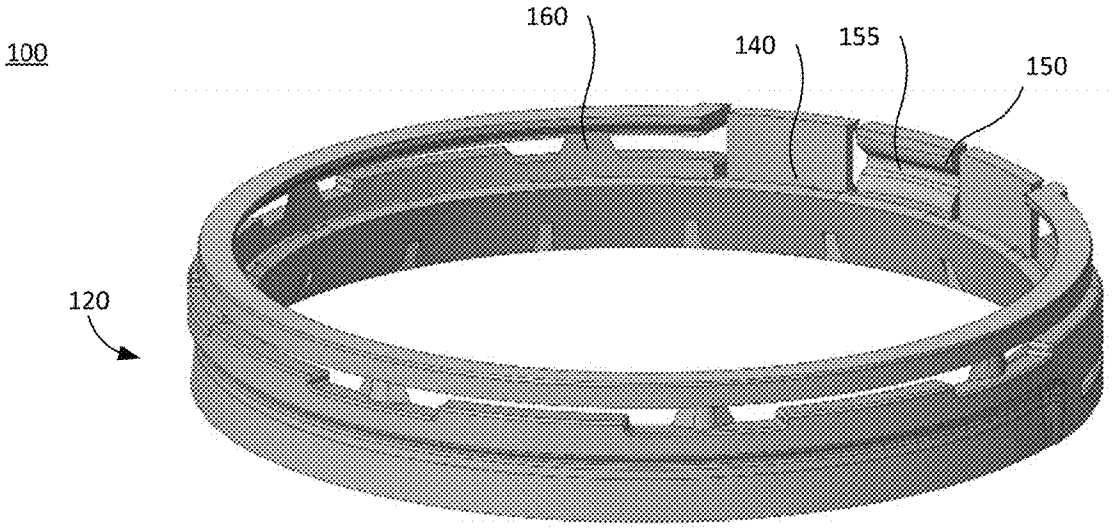
FIGS. 1G and 1H are perspective views of the tamper evident band of the closure.
Figure 1H:
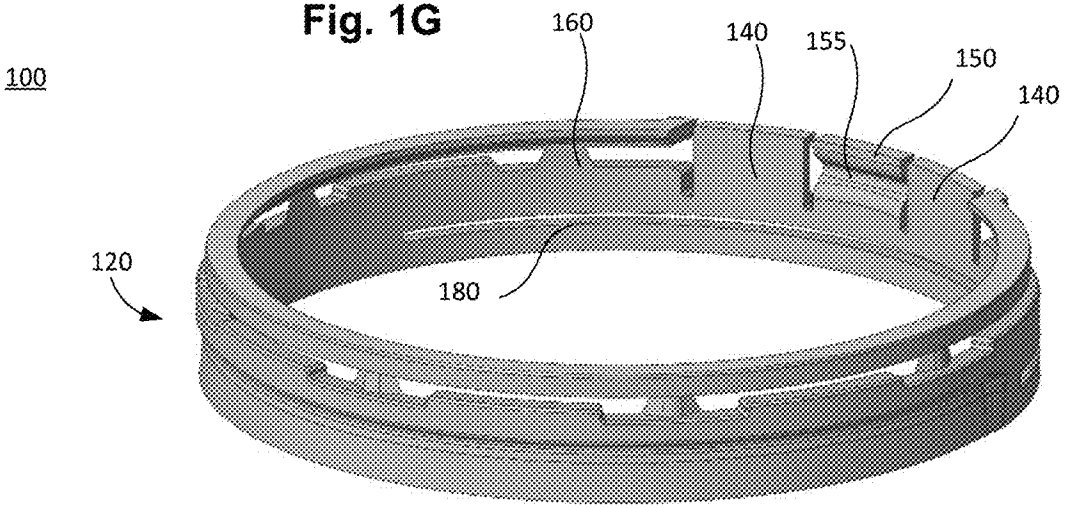
Figure 1I:
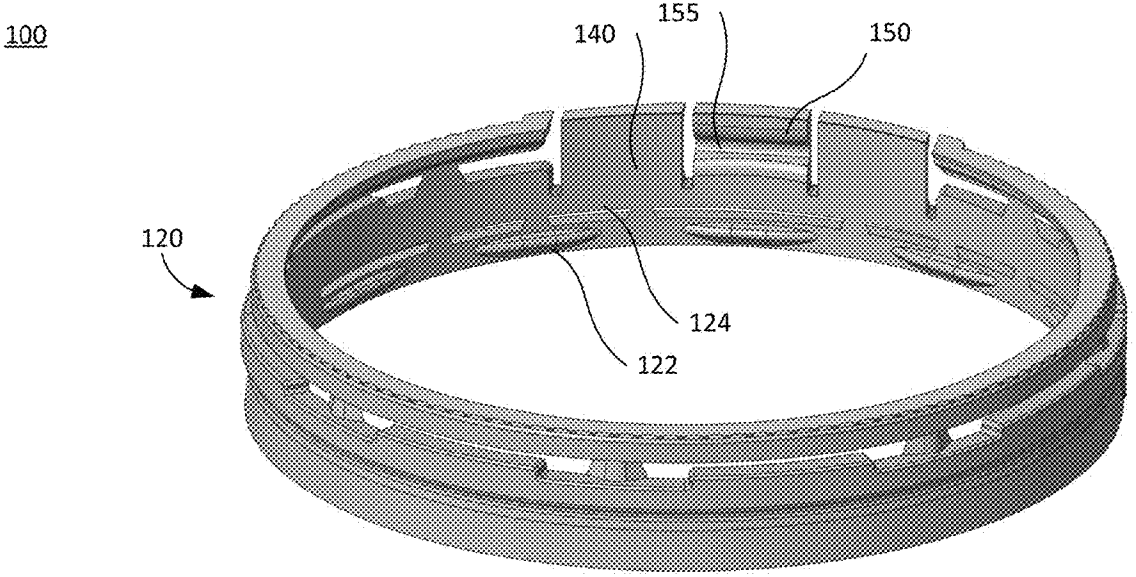
FIGS. 1I and 1J are perspective views of another embodiment of the tamper evident band of the closure, including beading.
Figure 1J:
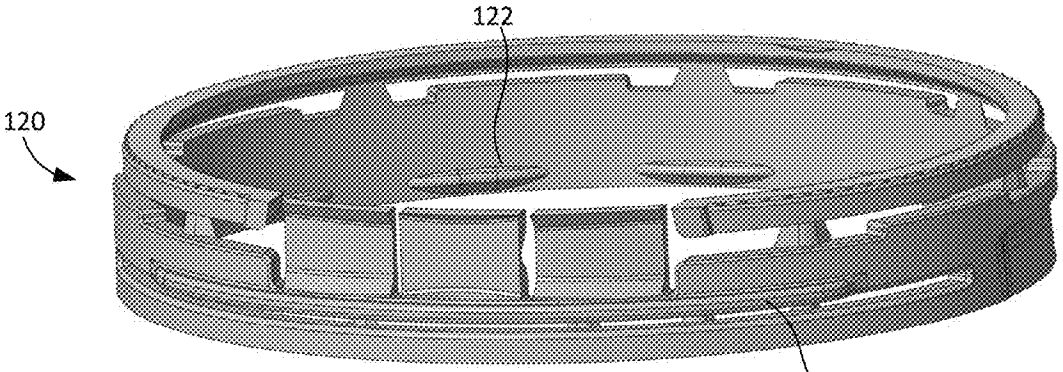

With reference now to FIGS. 1A-1H, an embodiment of the hinged closure 100 from various views is shown. FIG. 1A shows a perspective view; FIG. 1B provides an interior view including the hinge portion 130; FIG. 1C is a cross-sectional perspective view through central flexible portion 150; FIG. 1D is a cross-sectional perspective view through a connecting band 140; FIG. 1E is a side view of the closure 100 from the hinge portion 130. FIG. 1F is a cross-sectional view of an embodiment of the hinged closure 100 in the open position, attached to a container 195. FIGS. 1G and 1H are perspective views of a tamper evident band 120 of the closure. FIGS. 1I and 1J are perspective view of additional embodiments of the tamper evident band. In this embodiment of the hinged closure 100, the hinge portion 130 integrally connects the superior lid portion 110 with the inferior, ring-like tamper evident band 120. The hinge portion 130 includes two connecting bands 140 on either side of a central flexible portion 150, the central flexible portion 150 having a groove 155. The connecting bands 140 may be vertical, as shown, and thus parallel to one another. Alternatively, at least a portion of the connecting bands 140 can be curved (e.g., crescent shaped) or angled with respect to one another. In FIG. 1G, the tamper band is shown in a folded position. In FIG. 1H, the tamper band has been removed to show the horizontal slit 180. In other possible embodiments, the tamper band can be replaced with beads 122 and/or bridges 124 as a tamper-evident feature (FIG. 1I).

The connecting bands 140 are each integrally joined at the top portion to the lid portion 110 and each integrally joined at the bottom to the tamper evident band 120.

The central flexible portion 150 is located between the two connecting bands 140. The central flexible portion includes a groove 155. In some embodiments, the groove 155 is positioned on an upper portion of the central flexible portion 150. In other embodiments, the groove 155 is positioned on a middle portion of the central flexible portion 150. In some embodiments, the groove 155 can be horizontal to the long axis of the central flexible portion 150. One or more additional grooves can be located above and/or below the groove 155 to form a pinch area, which increases flexibility. The groove 155 can be located on the interior side of the upper lid portion 110. The central flexible portion 150 and two connecting bands 140 can be in the same plane or in different planes (e.g. along a curved plane). The central flexible portion 150 is integrally joined to the lid portion 110 and at the bottom to the tamper evident band 120. The open position in some embodiments may be greater than 180 degrees. Other optional features can also be included. For instance, bottom slitting 180 can be included in the tamper evident band 120 to allow bending (e.g., when the closure is opened by the end user); additional material can be added as slit reinforcement 185 (FIG. 1J) to bottom slitting 180; multiple bridges 160 can be added on the primary or secondary opening cut where needed; the opening 190 between the lid portion 110 and the hinge portion 130 may be angled to prevent undercutting during molding (e.g., hinge portion 130 can be vertical or angled dependent on the technology utilized); and knurls 170 can be included to reinforce the strength of the hinged closure 100. This reinforcement ensures adequate gripping during application of the closure, initial removal of the closure, and subsequent reclosing of the closure.

With reference now to FIGS. 2A-2F, an embodiment of the hinged closure 200 from various views is shown. In this embodiment, the hinge portion 230 comprises two connecting bands 240 and a central flexible portion 250 having a groove 255 on the exterior side.

Figure 2A:
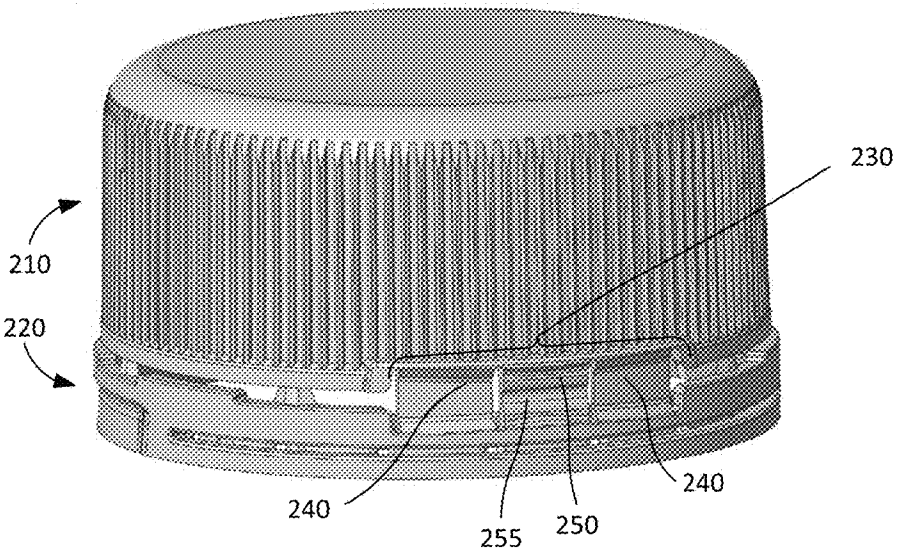
FIGS. 2A-2F provide another example of a hinged closure from various views in accordance with embodiments of the present disclosure, wherein the hinge portion comprises two connecting bands and a central flexible portion.
Figure 2B:
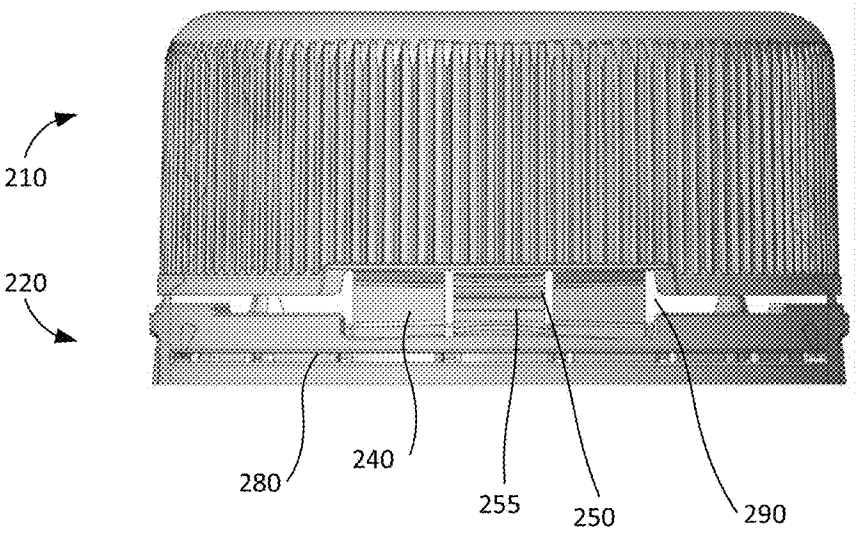
Figure 2C:
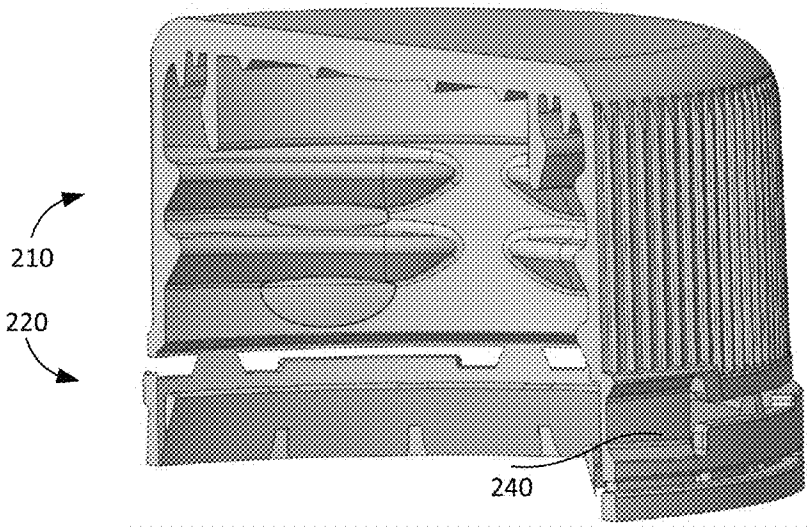
Figure 2D:
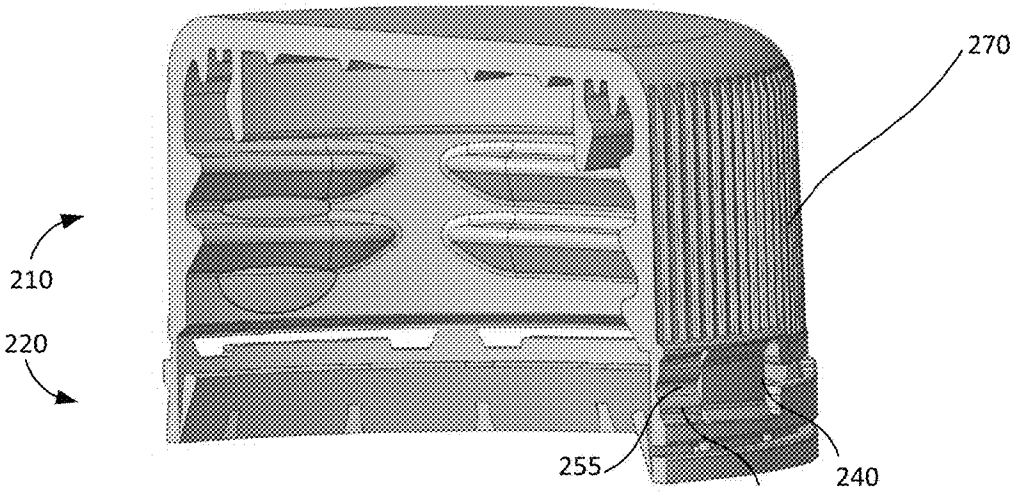
Figure 2E:
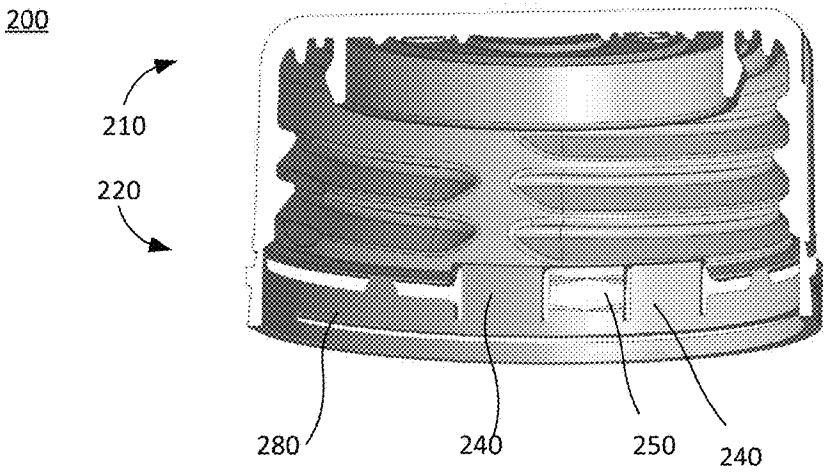
Figure 2F:
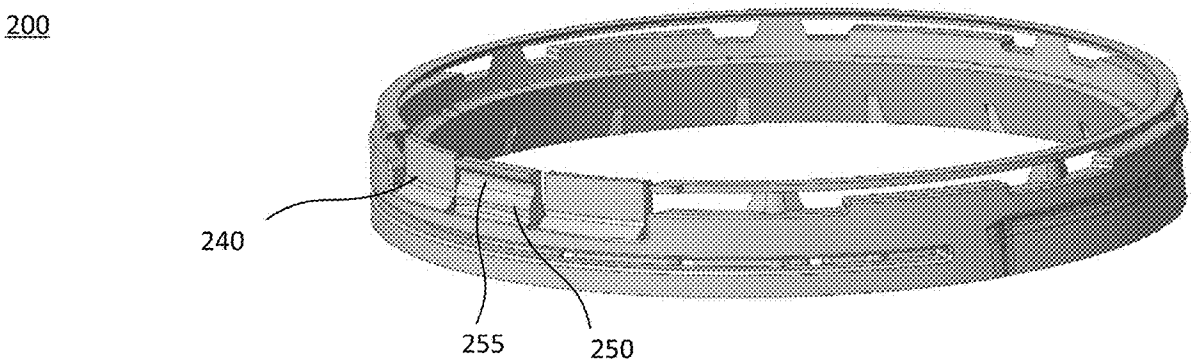

FIGS. 2A-2F provide another example of a hinged closure 200 from various views in accordance with embodiments of the present disclosure, wherein FIG. 2A shows a perspective view; FIG. 2B provides a side view including the hinge portion 230; FIG. 2C is cross-sectional perspective view through a connecting band 240; FIG. 2D is a cross-sectional perspective view through the central flexible portion 250; FIG. 2E provides an interior view including the hinge portion 230. FIG. 2F is a perspective view of an embodiment of the tamper evident band 220 of the closure. The hinge portion 230 integrally connects the superior lid portion 210 with the inferior, ring-like tamper evident band 220. The hinge portion 230 includes two parallel connecting bands 240 on either side of central flexible portion 250. In other embodiments (not shown), at least a portion of the connecting bands 240 are curved or angled with respect to one another (e.g., crescent shaped).

The connecting bands 240 are each integrally joined at the top portion to the lid portion 210 and integrally joined at the bottom to the tamper evident band 220. The central flexible portion 250 is located between the two connecting bands 240. At the top, the central flexible portion 250 is integrally joined to the lid portion 210 and, at the bottom, is integrally joined to the tamper evident band 220. The open position in some embodiments may be greater than 180 degrees. In some embodiments, the groove 255 can be non-linear, such as wider at the ends to form a bowtie shape for forming a pinch point.

The central flexible portion 250 can have at least one groove 255 that forms a joint and/or flex point at which the central flexible portion 250 rotates relative to the tamper evident band 120 such that the lid portion can open up to 180 degrees from the closed position. As described in reference to groove 155, the groove 255 functions as a reverse flex hinge that can flex and/or pop inwards upon opening the hinged closure 200, the central flexible portion 250 is thereby in a semi-locked position in the open condition. The closure can be flipped back to a closed position with a simple finger push. The groove 255 enables the upper lid portion 210 to be pivotable relative to the tamper evident band. The groove 255 can be on the exterior side (shown) or the interior side of the central flexible portion 250, depending upon the requirements of the closure.

In general, the groove 255 can be horizontal (e.g., zero degrees) to the long axis of the band. In some embodiments, a single groove 255 can be located in the center of the central flexible portion 250. In some embodiments, the groove 255 can be located near the upper portion of the central flexible portion 250. In other embodiments, a groove 255 can be located at both the upper and lower portions of the connecting band. In various embodiments, the groove 255 may be slightly tapered at the center to provide a pinch area.

Similar to various other embodiments, such as those shown in FIGS. 1A-1H, other optional features can also be included. For example, bottom slitting 280 can be included in the tamper evident band 220 to allow stretching during opening of the closure; additional material can be added as slit reinforcement 285 (not shown) to bottom slitting 280; the opening 290 between the lid portion 210 and the hinge portion 230 may be vertical or angled to prevent undercutting during molding; and knurls 270 can be included to reinforce the strength of the hinged closure 200 and to provide grip during application or cap removal and/or reclosing. Additional lines of articulation can be included on connecting bands 240 or central flexible portion 250 to direct the bending force.

Figure 3A:
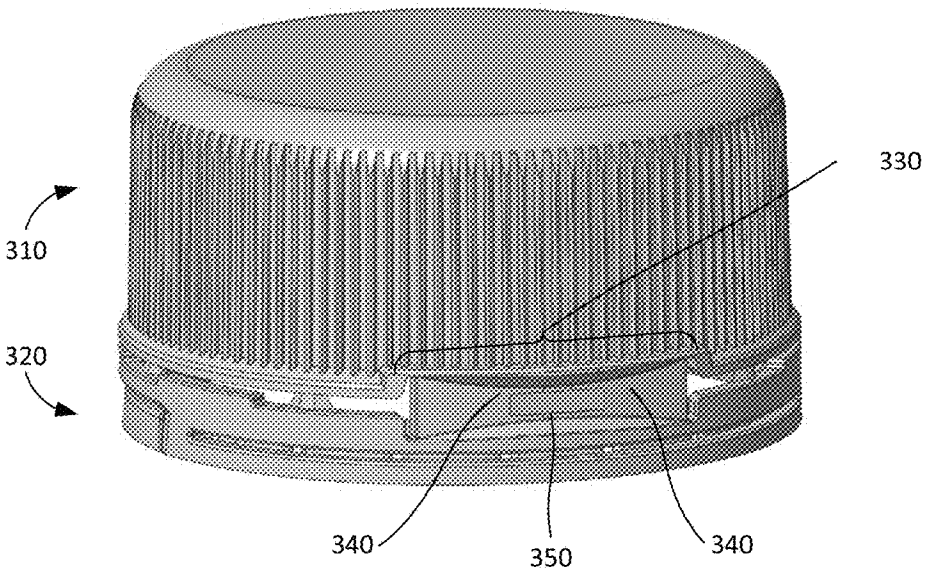
FIGS. 3A-3F provide another example of a hinged closure from various views in accordance with embodiments of the present disclosure, wherein the hinge portion comprises a continuous band having variable thickness and a central thinner flexible area.
Figure 3B:
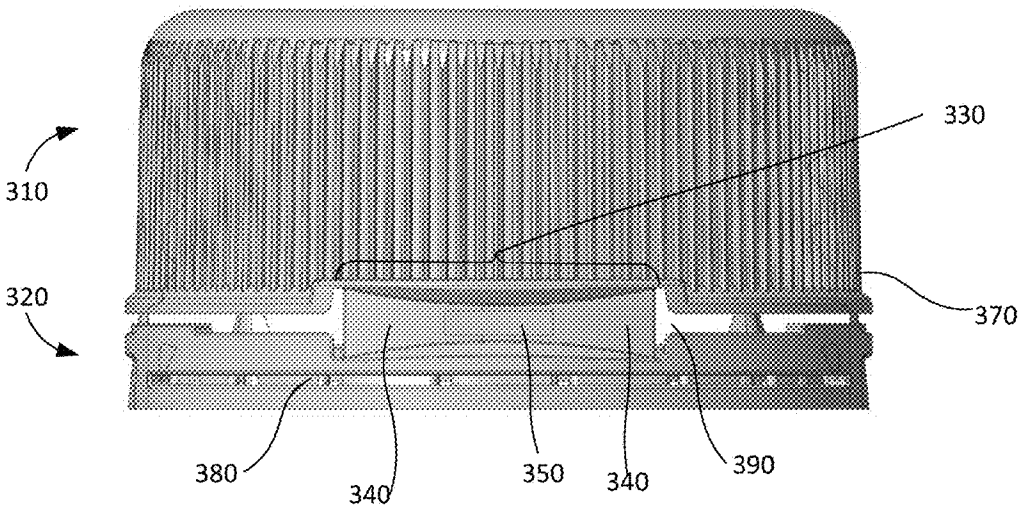
Figure 3C:
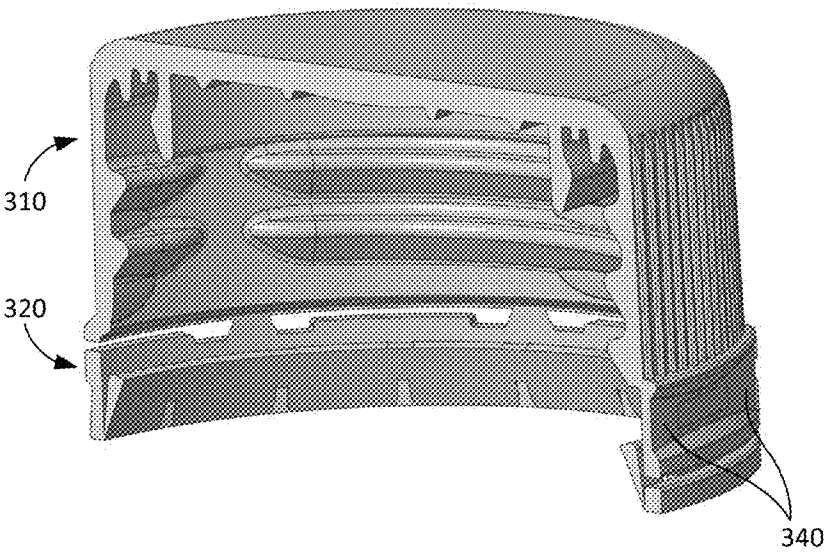
Figure 3D:
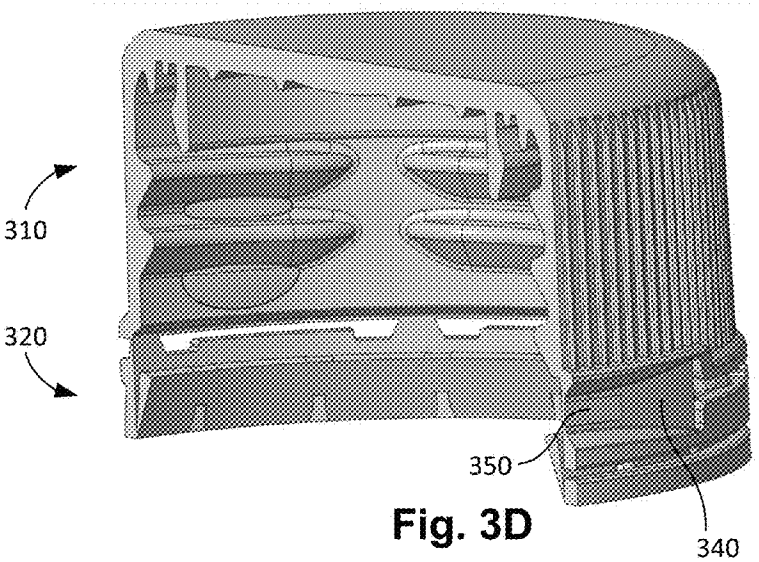
Figure 3E:
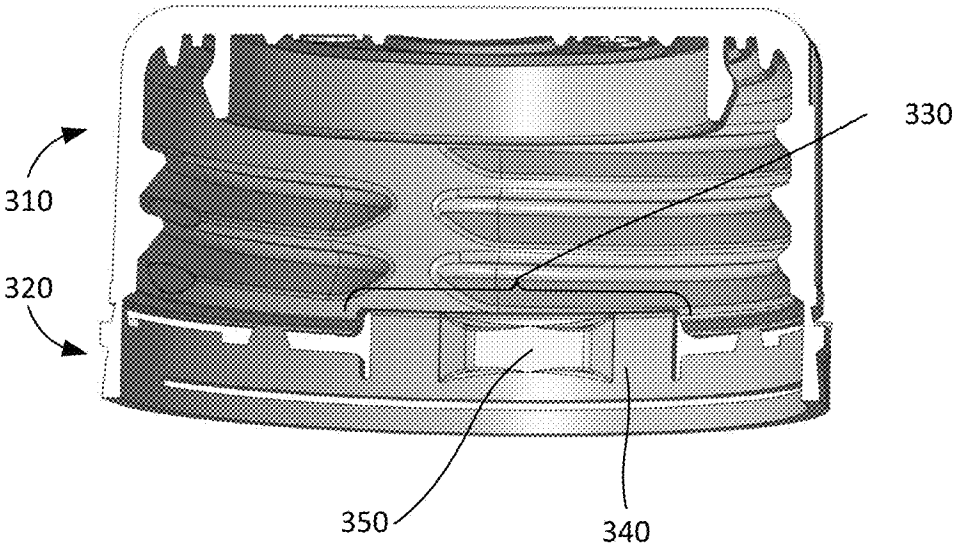

Turning to FIGS. 3A-3F, an embodiment of the hinged closure 300 from various views is shown. This embodiment includes a hinge portion 330 formed by a continuous band 340 having variable thickness and a central flexible pane 350. FIG. 3A shows a perspective view; FIG. 3B provides a side view including the hinge portion; FIG. 3C is cross-sectional perspective view through a thicker portion of the continuous band 340; FIG. 3D is a cross-sectional perspective view through the central flexible pane 350; FIG. 3E provides an interior view including the hinge portion 330.

Figure 3F:
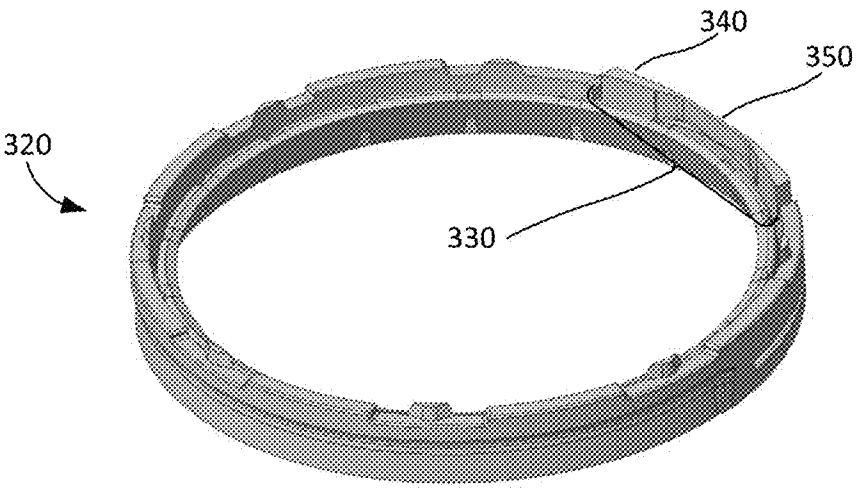

FIG. 3F is a perspective view of an embodiment of the tamper evident band 320 of the closure.

The central flexible pane 350 is a thinner flexible area blended, chamfered, or recessed into a thicker portion of the continuous band 340. The continuous band 340 functions similarly to the hinge portions shown in the previous embodiments. In this example, the thicker portions of continuous band 340 provide strength and bending capacity to the hinge portion 330, much like the connecting bands previously described. The central flexible pane 350 is a thin flexible area formed by a reverse undercut, such that when the hinged closure 300 is opened, central flexible pane 350 flexes inward to allow the superior lid portion 310 to be in a semi-locked open position. In this embodiment, the hinge portion 330 integrally connects the superior lid portion 310 with the inferior tamper evident band 320. The bottom and/or top portions of the central flexible pane 350 can be curved (FIG. 3C) to aid in the functionality of the hinge portion 330 (e.g. allowing it to remain locked in the open position). The height and width of the curvature will vary depending upon the size of the closure.

One or more grooves 355 (not shown) and/or lines of articulation can be included to increase flexibility and direct the bending of the hinge portion 330. The open position in some embodiments may be greater than 180 degrees.

As described in the previous embodiments, other optional features can also be included. For example, bottom slitting 380 can be included in the tamper evident band 320 to allow bending; additional material can be added as slit reinforcement 385 (not shown) to bottom slitting 380; the opening 390 between the lid portion 310 and the hinge portion 330 may be angled to prevent undercutting during molding; and knurls 370 can be included to reinforce the strength of the hinged closure 300.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that measurements, amounts, and other numerical data can be expressed herein in a range format. It is also understood that there are a number of values disclosed herein, and that each value is also herein disclosed as "approximately" that particular value in addition to the value itself. For example, if the value "10" is disclosed, then "approximately 10" is also disclosed. Similarly, when values are expressed as approximations, by use of the antecedent "approximately," it will be understood that the particular value forms a further aspect. For example, if the value "approximately 10" is disclosed, then "10" is also disclosed.

As used herein, the terms "about," "approximately," "at or about," and "substantially equal" can mean that the amount or value in question can be the exact value or a value that provides equivalent results or effects as recited in the claims or taught herein. That is, it is understood that amounts, sizes, measurements, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In general, an amount, size, measurement, parameter or other quantity or characteristic is "about," "approximate," "at or about," or "substantially equal" whether or not expressly stated to be such. It is understood that where "about," "approximately," "at or about," or "substantially equal" is used before a quantitative value, the parameter also includes the specific quantitative value itself, unless specifically stated otherwise.

Where a range is expressed, a further aspect includes from the one particular value and/or to the other particular value. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%;

about 0.5% to about 3.2%, and about 0.5% to about 4.4%, and other possible sub-ranges) within the indicated range.

What is claimed is:

1. A hinged closure for a container, comprising:

an upper lid portion;

a tamper evident band at a bottom edge of the upper lid portion;

a hinge portion comprising a pair of connecting bands, where each of the connecting bands integrally interconnects the lid portion and the tamper evident band, and a flexible portion positioned parallel to and between the pair of connecting bands, the flexible portion having at least one groove configured to at least partially deform to allow rotation of the flexible portion relative to the tamper evident band, where the flexible portion integrally interconnects the lid portion and the tamper evident band and wherein the flexible portion is separate from the connecting bands.

2. The hinged closure according to claim 1, wherein the hinge portion comprises a pair of flexible portions and a connecting band therebetween.

3. The hinged closure according to claim 1, wherein the groove is approximately parallel to an axis of rotation of the hinge portion, wherein the flexible portion bends inward along the at least one groove to allow the upper lid portion to remain in a semi-locked condition when the closure is in the open condition.

4. The hinged closure according to claim 1, wherein the groove is chamfered or angled at its center to allow bending of the flexible portion such that the upper lid portion remains in a semi-locked condition when the closure is in the open condition.

5. The hinged closure according to claim 3, wherein the groove is on an interior side of the central flexible portion.

6. The hinged closure according to claim 1, wherein the groove is on the exterior side of the central flexible portion.

7. The hinged closure according to claim 1, wherein the hinge portion rotates the lid portion relative to the tamper evident band portion such that the lid portion can rotate up to about 240 degrees from a closed position.

8. The hinged closure according to claim 1, wherein the hinge portion rotates the lid portion relative to the tamper evident band portion such that the lid portion can rotate up to about 180 degrees from a closed position.

9. The hinged closure according to claim 1, wherein the tamper-evident band further comprises a horizontal bottom slit.

10. The hinged closure according to claim 1, wherein the closure is formed by injection molding in a single piece.

* * * * *